US005641737A

United States Patent [19]

Forster

[11] Patent Number: 5,641,737

[45] Date of Patent: Jun. 24, 1997

[54] POWDERED SULFONES AS HIGH TEMPERATURE LUBRICANTS

[75] Inventor: Nelson H. Forster, Dayton, Ohio

[73] Assignee: The United States of America as represented by the Secretary of the Air Force, Washington, D.C.

[21] Appl. No.: 574,063

[22] Filed: Dec. 18, 1995

[51] Int. Cl.$^6$ ..... C10M 135/08

[52] U.S. Cl. ..... 508/568; 72/42

[58] Field of Search ..... 508/568

[56] References Cited

U.S. PATENT DOCUMENTS

| | | | |
|---|---|---|---|
| 2,998,453 | 8/1961 | Nichols | 508/568 |
| 3,494,963 | 2/1970 | Anderson | 260/583 |
| 5,066,409 | 11/1991 | Nader | 508/568 |

*Primary Examiner*—Ellen M. McAvoy

*Attorney, Agent, or Firm*—Charles E. Bricker; Thomas L. Kundert

[57] ABSTRACT

Substituted biphenyl sulfones of the formula:

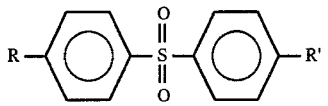

wherein R is

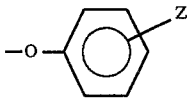

wherein Z is —H, —$CH_3$, —$CF_3$, —F, —$OCH_3$ or —$OCF_3$; and R' is —R or —H, are useful as lubricants in the temperature range of up to about 750° F.

1 Claim, No Drawings

POWDERED SULFONES AS HIGH TEMPERATURE LUBRICANTS

RIGHTS OF THE GOVERNMENT

The invention described herein may be manufactured and used by or for the Government of the United States for all governmental purposes without the payment of any royalty.

BACKGROUND OF THE INVENTION

This invention relates to solid lubricants for lubricating movable machine parts.

Operation of bearings, gears, cams and other mechanical components in conventional gas turbine and automotive engines are generally limited to temperatures of about 350° to 400° F., because the conventional liquid lubricants used in the engines usually thermally decompose above about 400° F. Advanced turbine engines and other high temperature engine types (stirling, adiabatic, diesel) may require bearing operation above 1000° F. and therefore require alternate lubrication systems. Conventional solid lubricants such as molybdenum disulfide ($MoS_2$) and tungsten disulfide ($WS_2$) are useful to about 800° F. and may be used in coating or powder form. Advanced solid lubricants such as cesium oxythiotungstenate ($Cs_2WOS_3$) and other complex chalcogenide lubricants, either in coating or in powder form, have been shown. to perform well at temperatures above 1200° F. However, specialized equipment for pretreating bearing surfaces and applying a lubricant coating thereon, or for delivering the powder form to the bearing surfaces, in the utilization of advanced lubricants in either coating or powder form may be required.

I have discovered that substituted biphenyl sulfones are useful as lubricants in the temperature range of up to about 750° F.

Accordingly, it is an object of the present invention to provide novel lubricating materials.

Other objects and advantages of the present invention will be apparent to those skilled in the art.

SUMMARY OF THE INVENTION

In accordance with the present invention there are provided novel lubricating materials which comprise biphenyl sulfones of the formula:

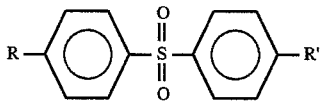

wherein R is

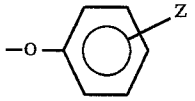

wherein Z is —H, —$CH_3$, —$CF_3$, —F, —$OCH_3$ or —$OCF_3$; and R' is —R or —H.

DETAILED DESCRIPTION OF THE INVENTION

The substituted biphenyl sulfones which are useful as lubricants include the following:

bis(4-phenoxyphenyl) sulfone

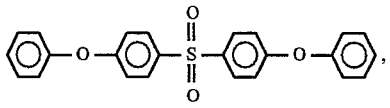

bis(4-(3-trifluoromethyl)phenoxyphenyl) sulfone

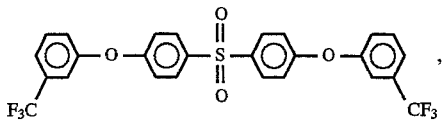

bis(4-(3-methoxy)phenoxyphenyl) sulfone

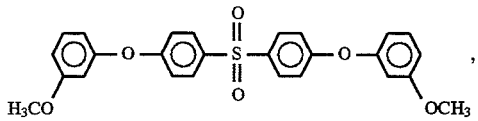

bis(4-(4-trifluoromethoxy)phenoxyphenyl) sulfone

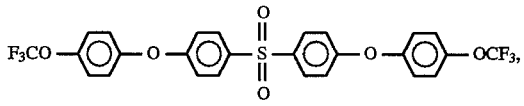

bis(4-(3-trifluoromethoxy)phenoxyphenyl) sulfone

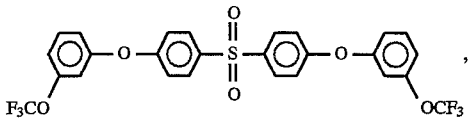

bis(4-(2-fluorophenoxy)phenyl) sulfone

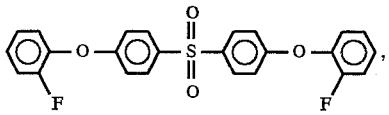

bis(4-(3-fluorophenoxy)phenyl) sulfone

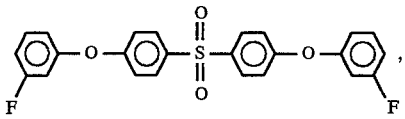

and bis(4-(4-fluorophenoxy)phenyl) sulfone

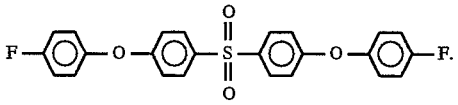

The above-listed sulfones were obtained from The Dow Chemical Company, Midland, Mich.

The following examples illustrate the invention. The bearing tests were performed with a 30 mm bore angular contact bearing. This geometry is typical of the size used in some expendable turbine engines. The test temperature was limited to a maximum of 350° F., because of the materials used in the bearings (52100 steel with phenolic cages). In these examples, bis(4-phenoxyphenyl) sulfone (designated XLS 1) and bis(4-(3-trifluoromethyl)phenoxyphenyl) sulfone (designated XLS 2) are compared to $WS_2$. The test materials were delivered in powdered form, using ambient temperature air to carry the powder to the test bearing. A 150 pound bearing thrust load was used in all the tests. The quantities used were: 1.5 g/hr for the XLS powders and 6.0 g/hr for the $WS_2$.

EXAMPLE

XLS+b 1:

Test 1:

From time zero ($t_0$) to time 60 minutes ($t_{60}$), the bearing speed was incrementally increased from 0 to 30,000 rpm. No external heat was applied to the bearing during the test. At $t_{60}$, the bearing temperature was 145° F. (ΔT=70° F.), bearing torque was 0.325 in-lb (0.65 lbf×0.5 in moment).

Test 2:

The conditions of Test 1 were repeated; the results were essentially the same.

Test 3:

Following Tests 1 and 2, the test rig was shut down without removing the bearing. Heat was applied to the test head to bring the bearing temperature to 280° F. At $t_{60}$, the bearing temperature was 350° F. (ΔT=70° F.). Bearing torque was unmeasurable for the first 30 minutes (up to 20,000 rpm) and 0.175 in-lb at 30,000 rpm.

XLS+b 2:

Test 1:

From $t_0$ to $t_{60}$, the bearing speed was incrementally increased from 0 to 30,000 rpm. No external heat was applied to the bearing during the test. At $t_{60}$, the bearing temperature was 175° F. (ΔT=100° F.), bearing torque was 0.55 in-lb.

Test 2:

The conditions of XLS1 Test 3 were repeated, except that the bearing was heated to 240° F. instead of 280° F. At $t_{60}$, the bearing temperature was 350° F. (ΔT=110° F.). Bearing torque was 0.63 in-lb at 30,000 rpm.

$WS_2$

From $t_0$ to $t_{60}$, the bearing speed was incrementally increased from 0 to 30,000 rpm. No external heat was applied to the bearing during the test. Speed was held constant at 30,000 rpm during the period of 60 to 75 minutes. At $t_{70}$, the bearing temperature was 260° F. (ΔT=185° F.). Bearing torque was 4–5 in-lb at 30,000 rpm.

It is readily apparently, from the temperature increase and torque data given above, that the biphenyl sulfones provide much better lubrication than $WS_2$, the state-of-the-art powder lubricant for the temperature range used in these tests.

The biphenyl sulfones of this invention can be used as dry powder lubricants, as illustrated above. They may also be formulated into grease and oil compositions in place of ordinary lubricants such as $WS_2$. For applications, such as metal forging, the sulfones are preferably dispersed in water (e.g., a 0.5 to 5.0 w/o dispersion), together with a suitable surfactant, to keep atmospheric dispersal to a minimum.

Various modifications may be made in the instant invention without departing from the spirit and scope of the appended claims.

I claim:

1. A lubricant for hot metal working applications consisting essentially of water and about 0.5 to 5.0 weight percent of a biphenyl sulfone of the formula:

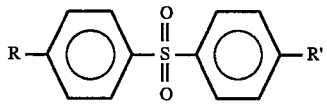

wherein R is

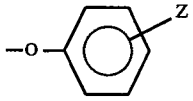

wherein Z is —H, —$CH_3$, —$CF_3$, —F, —$OCH_3$ or —$OCF_3$; and R' is —R or —H.

* * * * *